US007589161B2

(12) United States Patent
Ho et al.

(10) Patent No.: US 7,589,161 B2
(45) Date of Patent: Sep. 15, 2009

(54) POLYMERIC QUENCHANT, MANUFACTURE THEREOF, AND METHOD FOR QUENCHING STEEL

(75) Inventors: George Ho, Hsinchu (TW); Li Kuei Lin, Hsinchu (TW); Wen-Faa Kuo, Hsinchu (TW)

(73) Assignees: Industrial Technology Research Institute, Hsinchu (TW); Gelie Co., Ltd., Changhua County (TW)

( * ) Notice: Subject to any disclaimer, the term of this patent is extended or adjusted under 35 U.S.C. 154(b) by 0 days.

(21) Appl. No.: 11/942,750

(22) Filed: Nov. 20, 2007

(65) Prior Publication Data

US 2009/0065107 A1 Mar. 12, 2009

(30) Foreign Application Priority Data

Sep. 7, 2007 (TW) ..... 96133350 A

(51) Int. Cl.
*C08F 220/06* (2006.01)
*C08F 220/56* (2006.01)

(52) U.S. Cl. ..... 526/307.2; 526/307.5; 526/307.6; 526/317.1; 526/348; 148/121; 148/122; 148/197; 148/198; 148/596

(58) Field of Classification Search ..... 148/121, 148/122, 197, 198, 596; 526/307.2, 307.5, 526/307.6, 317.1, 348
See application file for complete search history.

(56) References Cited

U.S. PATENT DOCUMENTS

| | | | | |
|---|---|---|---|---|
| 3,939,016 | A * | 2/1976 | Tokuue et al. | 148/28 |
| 3,996,076 | A * | 12/1976 | Tokuue et al. | 148/638 |
| 4,528,044 | A * | 7/1985 | Warchol | 148/638 |
| 4,738,731 | A * | 4/1988 | Foreman et al. | 148/626 |
| 2005/0256014 | A1 * | 11/2005 | Sherman et al. | 508/579 |

* cited by examiner

*Primary Examiner*—Ling-Siu Choi
(74) *Attorney, Agent, or Firm*—Thomas, Kayden, Horstemeyer & Risley

(57) ABSTRACT

A polymeric quenchant. The polymeric quenchant comprises an inorganic nanoparticle, a water-soluble polymer, and water, wherein a weight ratio of the inorganic nanoparticle, water-soluble polymer and water is about 0.05-5:1-5:100. The cooling rate of steel during a quenching process can be adjusted by regulating the components and ratios of the adjusted by regulating the components and ratios of the polymeric quenchant to achieve desirable steel properties.

10 Claims, 8 Drawing Sheets

POLYMERIC QUENCHANT, MANUFACTURE THEREOF, AND METHOD FOR QUENCHING STEEL

BACKGROUND OF THE INVENTION

1. Field of the Invention

The present invention relates to a quenchant, and in particular relates to a polymeric quenchant for adjusting cooling curve.

2. Description of the Related Art

Hardening of steel components is one of the most commonly practiced heat treatment operations in the steel industry. The hardening process comprises heating the steel components to austenitizing temperature (about 800-1000° C.), soaking the steel components at austenitizing temperature for thermal homogenization, and then quenching the steel components in an appropriate medium to room temperature. Quenching is a process whereby a steel component heated to a given elevated temperature is rapidly cooled by immersion in a quench bath containing compositions having a high heat-extracting capability such as air, water, brines, oils or polymer solutions.

Water and brine baths are easily disposed of and relatively inexpensive, however, such baths cool at extremely rapid rates and frequently provide metals quenched therein with a strained microstructure that is susceptible to warpage and cracking. Oil baths typically provide the quenched metals with relatively slow cooling rates, however, oils are expensive materials to use, have relatively low flash points which create a risk of fire, and oftentimes leave an undesirable film on the quenched metals.

Low cost aqueous solutions or dispersions of organic polymers have been developed which combine many of the cooling rate advantages of oils with the safety and disposal features of water and brine baths. Unlike oils which tend to form undesirable degradation products, which require removal from tanks prior to bath replacement, organic polymer-containing quench baths generally do not form system-fouling products. Thus, organic polymer-containing compositions are of particular interest for development.

However, quenching effect relates to quenchant cooling rate, specific heat, viscosity, and thermal conduction so that different quenchants are required for different types of steels. Thus, although the traditional polymer-containing quenchant simultaneously has the advantages of the water and oil quenchant solutions, it still does not satisfy steel industry requirements. Thus, a novel quenchant and quenching process are needed.

BRIEF SUMMARY OF INVENTION

The invention provides a polymeric quenchant, comprising an inorganic nanoparticle, a water-soluble polymer, and water, wherein a weight ratio of the inorganic nanoparticle, water-soluble polymer and water is about 0.05-5:1-5:100.

The invention further provides a method for manufacturing a polymeric quenchant, comprising: providing an inorganic nanoparticle, wherein the inorganic nanoparticle is dispersed in water and adding a water-soluble polymer to the water comprising the inorganic nanoparticle; wherein a weight ratio of the inorganic nanoparticle, water-soluble polymer and water is about 0.05-5:1-5:100.

The invention further provides a method for quenching a steel, comprising providing a steel, heating the steel, and quenching the steel using the polymeric quenchant of the invention, wherein the steel has a temperature of maximum cooling rate exceeding 500° C., and a cooling rate at 300° C. less than 30° C./sec during the quenching process.

A detailed description is given in the following embodiments with reference to the accompanying drawings.

BRIEF DESCRIPTION OF DRAWINGS

The present invention can be more fully understood by reading the subsequent detailed description and examples with references made to the accompanying drawings, wherein.

DETAILED DESCRIPTION OF INVENTION

Figure 1:
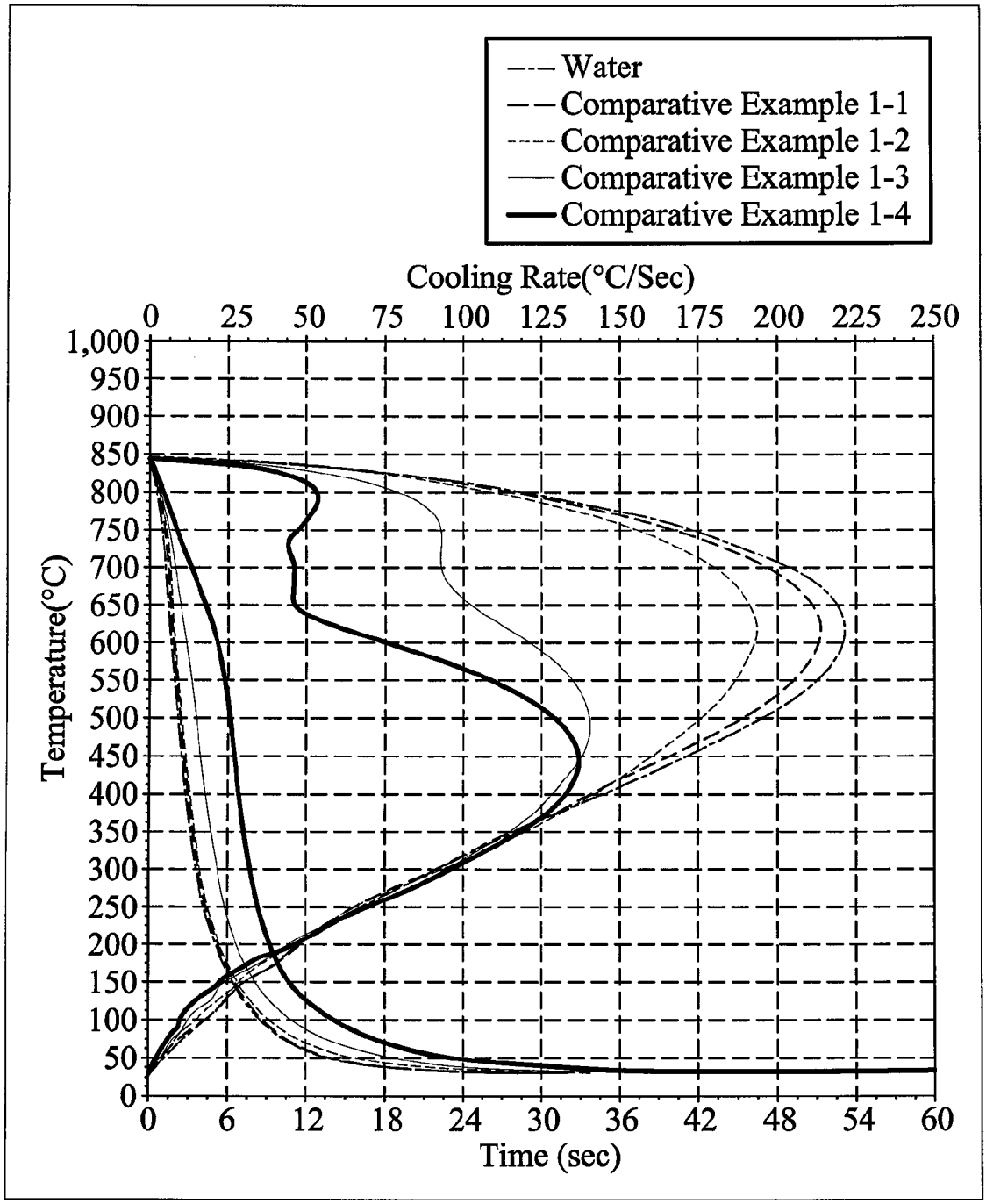
FIG. 1 is a graph plotting time and cooling rate against temperature of the quenchant as disclosed in Comparative Example 1.

The following description is of the best-contemplated mode of carrying out the invention. This description is made for the purpose of illustrating the general principles of the invention and should not be taken in a limiting sense. The scope of the invention is best determined by reference to the appended claims.

The invention provides a polymeric quenchant comprising an inorganic nanoparticle, a water-soluble polymer, and water. The polymeric quenchant of the invention can regulate cooling rate, cooling curve, and hardening of the steels.

The inorganic nanoparticle of the invention includes, but are not limited to, talc, smectite clay, vermiculite, halloysite, sericite, saponite, montmorillonite, beidellite, nontronite, mica, hectorite or a combination thereof. It should be noted that, different inorganic nanoparticle can result in different quenching effects. The inorganic nanoparticle has a diameter of 0.2-10 μm, preferably, 0.2-5.0 μm so that the inorganic nanoparticle can be sufficiently dispersed in a quenchant to induce the viscosity of the quenchant and suppress thermal conduction thereof.

The water-soluble polymer of the invention includes, but is not limited to, polyalkylene glycol, polyvinyl pyrrolidone, polyacrylate, polyvinyl alcohol, polyacrylamide, poly(ethyloxazoline), polyalphaolefin, poly(ethylene glycol), polyethylenimine, or a combination thereof.

The polymeric quenchant of the invention comprises an inorganic nanoparticle, a water-soluble polymer, and water, wherein a weight ratio of the inorganic nanoparticle, water-soluble polymer and water is about 0.05-5:1-5:100, preferably, 0.05-3:2-4:100, and the weight ratio can be adjusted depending on different situations. For example, the ratios of the quenchant components can be adjusted to control polymeric quenchant properties such as heat condition.

In one embodiment, the polymeric quenchant of the invention further comprises adding a functional agent, such as triethylamine or triethanolamine to increase quenchant functions. For example, an anti-corrosion agent is added to prevent the corrosion of the steels. Meanwhile, the functional agent is present in an amount from about 0.5% to about 10% by weight of the quenchant.

In the invention, the polymeric quenchant properties (e.g. thermal conduction) can be adjusted by different inorganic nanoparticles, and the ratios of the inorganic nanoparticle, a water-soluble polymer, and water can be adjusted to obtain various polymeric quenchants. Thus, the polymeric quenchant of the invention can effectively control the cooling rate, tenacity, strength, and hardening of the steels to obtain various steel products. Compared with conventional quenchants, the polymeric quenchant of the invention has a lot of advantages, such as non-toxicity, and recyclable capabilities.

The invention further provides a method of manufacturing a polymeric quenchant. The method comprises (a) providing an inorganic nanoparticle, wherein the inorganic nanoparticle is dispersed in water, and (b) adding a water-soluble polymer to the water comprising the inorganic nanoparticle to form a polymeric quenchant. Additionally, a heating process can be carried out in step (a) to induce the dispersion of the inorganic nanoparticles in water if it is necessary.

In one embodiment, a function agent such as anti-corrosion agent can be added to the polymeric quenchant in step (b) to increase the quenchant's functions.

The invention further provides a method for quenching steel, comprising (a) providing a steel, (b) heating the steel, and (c) quenching the steel using the polymeric quenchant of the invention. During steel quenching, the steel has a maximum cooling rate of about 60-160° C./sec, preferably 80-160° C./sec, a temperature of maximum cooling rate exceeding 500° C., preferably, exceeding 600° C., and a cooling rate at 300° C. less than 30° C./sec, preferably less than 25° C./sec.

In the invention, the method of quenching steel can adjust cooling curve of steel (e.g. maximum cooling rate, temperature at maximum cooling rate, temperature at start of boiling, and cooling rate at 300° C.) by regulating the components and ratios of the polymeric quenchant.

The cooling curve of steels can be classified into three phases comprising steam film, boiling, and convection. To obtain a steel having high hardness properties but without hardening cracks and deformation, the steel should be cooled rapidly when above Ms point temperature to prevent deformation and cooled slowly when less than Ms point temperature. Ms point temperature is a start temperature of martensite transformation from austenite, and is about 200° C. to 300° C.

The polymeric quenchant of the invention can satisfy the above requirements. For example, when an amount of the inorganic nanoparticle and/or water-soluble polymer is increased, the polymeric quenchant of the invention can slowdown maximum cooling rate and cooling rate of steels at 300° C. to achieve desirable steel properties. Additionally, at maximum cooling rate of steels, temperature is higher than that of conventional quenchants. The cooling curve of the steels is gradually flatted when the temperature of the steels is decreased.

EXAMPLE

Analysis of ASTM D6482 Modeling

Comparative Example 1

Effect of Inorganic Nanoparticle to Cooling Curve

PK 812 inorganic nanoparticle (PAI KONG NANO Technology Co., LTD) was sufficiently dispersed in water to obtain a quenchant having 1 wt %, 2 wt %, 3 wt %, and 5 wt % of a PK 812, respectively. The properties of these quenchants were analyzed by an ASTM D6482 cooling curve analysis method using an IVF Smart Quench (IVF Industrial R&D Corporation). Referring to FIG. 1 and Table 1, maximum cooling rate and temperature thereof decreased, dependent upon increasing concentrations of the inorganic nanoparticle, but cooling rate at 300° C. did not greatly change.

TABLE 1 properties of Comparative Example 1 quenchant

| | Water | Comparative Example 1-1 | Comparative Example 1-2 | Comparative Example 1-3 | Comparative Example 1-4 |
|---|---|---|---|---|---|
| SQ1500 Con. (wt %) | 0 | 0 | 0 | 0 | 0 |
| PK 812 Con. (wt %) | 0 | 1 | 2 | 3 | 5 |
| Maximum Cooling Rate (° C./sec) | 221.43 | 213.24 | 193.03 | 140.42 | 136.8 |
| Temp. Max. Cooling rate (° C.) | 611.42 | 620 | 612.43 | 493.86 | 448.2 |
| Temp. at Start of Boiling (° C.) | 846.13 | 846.26 | 847.89 | 713.19 | 667.36 |
| Temp. at Start of Convection (° C.) | 41.5 | 71.91 | 83.55 | 104.75 | 97.69 |
| Cooling Rate at 300° C. (° C./sec) | 90.59 | 89.44 | 91.72 | 93.54 | 94.69 |
| Time to 600° C. (sec) | 1.54 | 1.7 | 1.8 | 2.8 | 5.1 |
| Time to 400° C. (sec) | 2.61 | 2.81 | 2.97 | 4.28 | 6.81 |
| Time to 200° C. (sec) | 5.05 | 5.27 | 5.41 | 6.73 | 9.18 |

Comparative Example 2

Effect of Inorganic Nanoparticle to Cooling Curve

Figure 2:
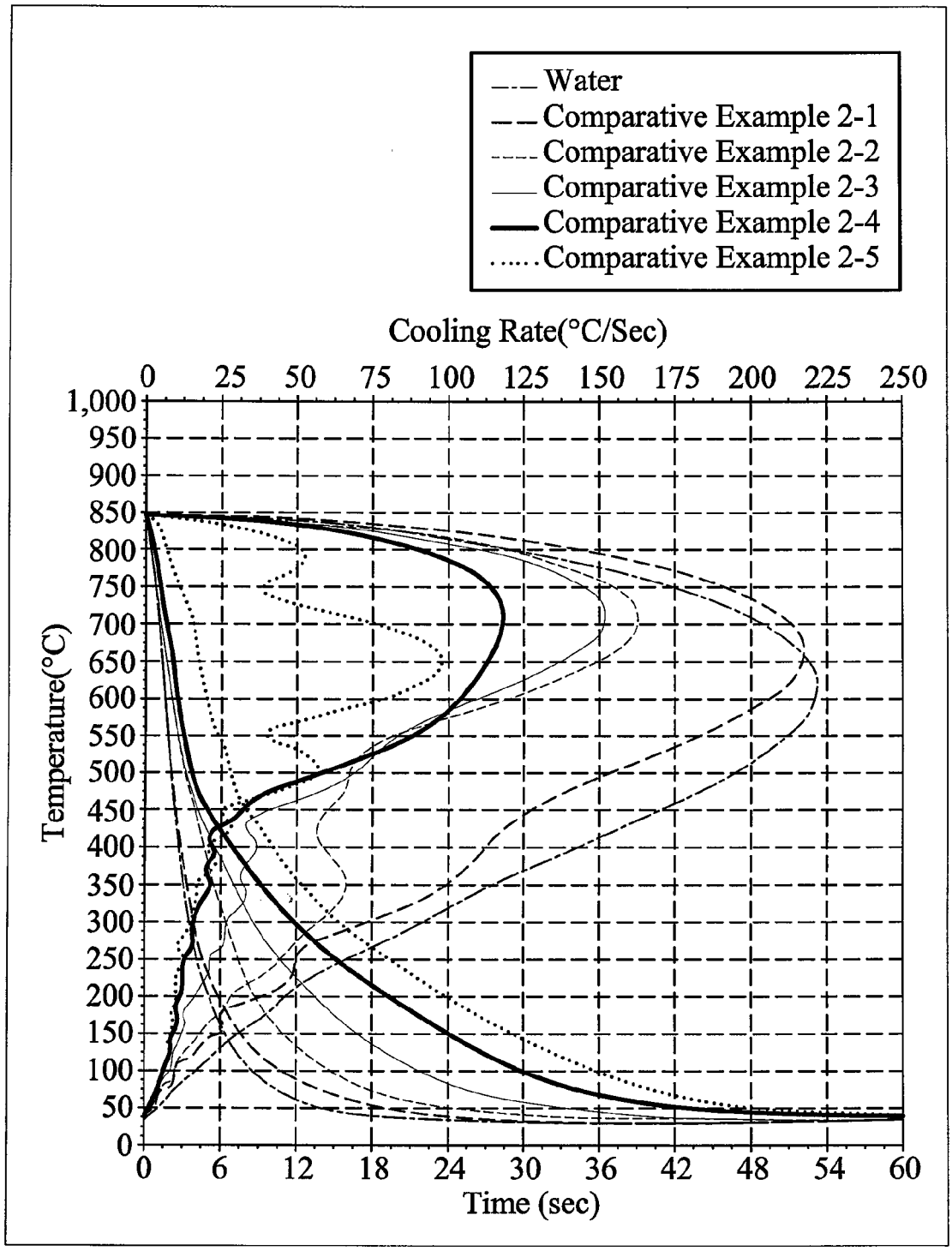
FIG. 2 is a graph plotting time and cooling rate against temperature of the quenchant as disclosed in Comparative Example 2.

The same procedure carried out in Comparative Example 1 was repeated except that the components of the quenchant was changed to 5 wt %, 10 wt %, 15 wt %, 20 wt %, 25 wt % of an SQ1500 polymer quenchant (GELIE CO., LTD). Referring to FIG. 2 and Table 2, maximum cooling rate and cooling rate at 300° C. decreased, dependent upon increasing concentrations of the SQ1500 polymer quenchant, but temperature of the maximum cooling rate did not greatly changed.

TABLE 2

| properties of Comparative Example 2 quenchant | | | | | | |
|---|---|---|---|---|---|---|
| | Water | Comparative Example 2-1 | Comparative Example 2-2 | Comparative Example 2-3 | Comparative Example 2-4 | Comparative Example 2-5 |
| SQ1500 Con. (wt %) | 0 | 5 | 10 | 15 | 20 | 25 |
| inorganic nanoparticle Con. (wt %) | 0 | 0 | 0 | 0 | 0 | 0 |
| Maximum Cooling Rate (° C./sec) | 221.43 | 217.65 | 163.14 | 151.86 | 118.03 | 97.57 |
| Temp. Max. Cooling rate (° C.) | 611.42 | 666.01 | 700.13 | 706.03 | 710.88 | 652.38 |
| Temp. at Start of Boiling (° C.) | 846.13 | 849.23 | 848.24 | 846.15 | 848.16 | 747.03 |
| Temp. at Start of Convection (° C.) | 41.5 | 172.78 | 420.15 | 428.07 | 410.67 | 552.1 |
| Cooling Rate at 300° C. (° C./sec) | 90.59 | 72.97 | 56.45 | 26.74 | 16.6 | 14.94 |
| Time to 600° C. (sec) | 1.54 | 1.42 | 1.92 | 2.02 | 2.47 | 4.79 |
| Time to 400° C. (sec) | 2.61 | 2.75 | 4.75 | 5.51 | 6.87 | 9.94 |
| Time to 200° C. (sec) | 5.05 | 5.74 | 8.7 | 13.26 | 19.25 | 23.86 |

Working Example 1

Effect of Inorganic Nanoparticle to Cooling Curve

Figure 3A:
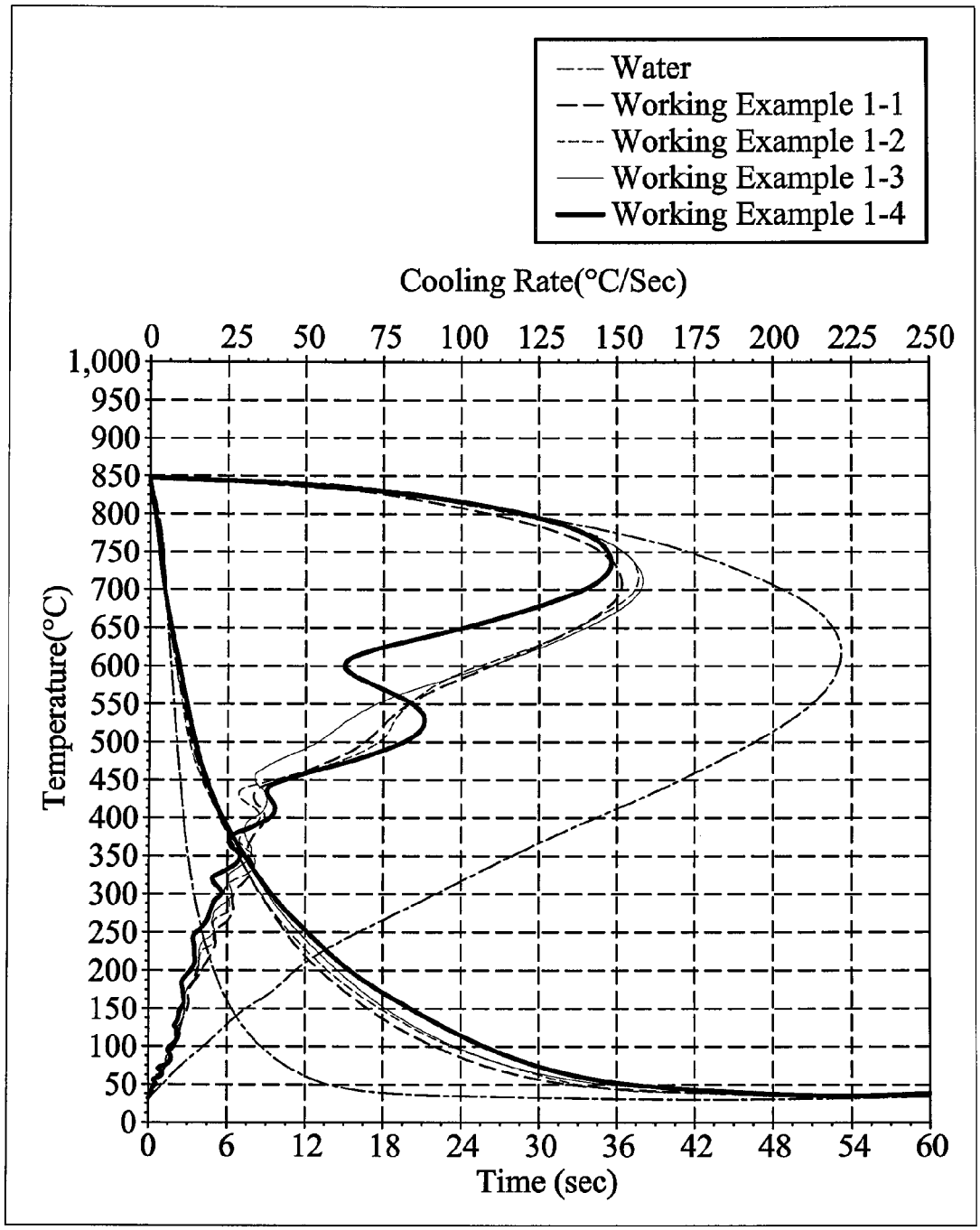
FIGS. 3A-3B are graphs plotting time and cooling rate against temperature of the quenchant as disclosed in Working Example 1.
Figure 3B:
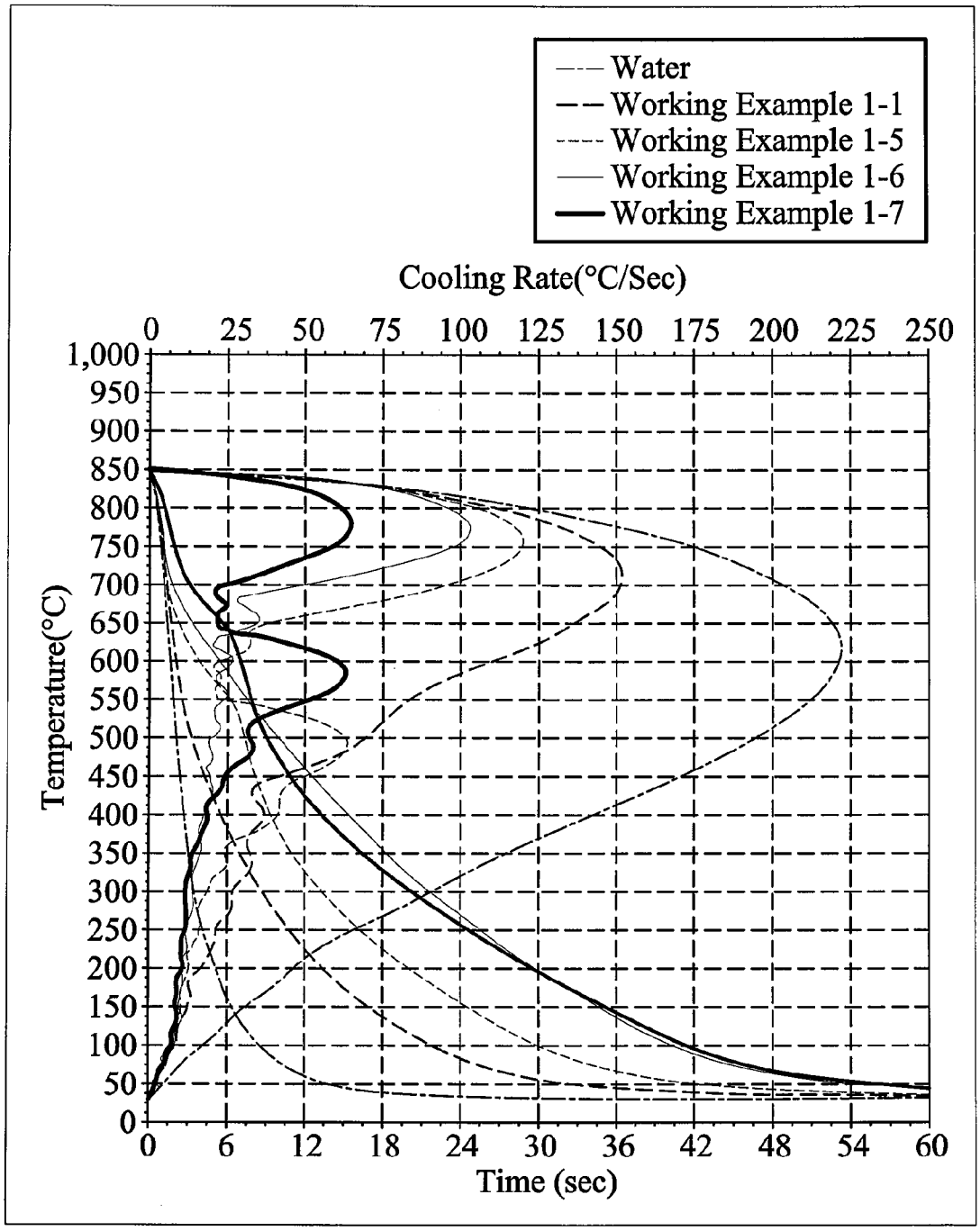

The same procedure carried out in Comparative Example 1 was repeated except that the components of the quenchant was changed to 0.05 wt %, 0.1 wt %, 0.2 wt %, 0.5 wt %, 1.0 wt %, and 1.5 wt % of a PK 812 inorganic nanoparticle, respectively, and 15 wt % of an SQ1500 polymer. Referring to FIG. 3 and Table 3, maximum cooling rate and cooling rate at 300° C. decreased, dependant upon increasing concentrations of the PK 812 inorganic nanoparticle, but temperature at start of convection increased from 420° C. to more than 670° C. Additionally, temperature of maximum cooling rate increased, dependant upon the increased amount of PK 812 inorganic nanoparticle.

TABLE 3

| properties of Working Example 1 quenchant | | | | |
|---|---|---|---|---|
| | Water | Working Example 1-1 | Working Example 1-2 | Working Example 1-3 |
| SQ1500 Con. (wt %) | 0 | 15 | 15 | 15 |
| PK 812 Con. (wt %) | 0 | 0 | 0.05 | 0.1 |
| Maximum Cooling Rate (° C./sec) | 221.43 | 151.86 | 157.24 | 158.35 |
| Temp. Max. Cooling rate (° C.) | 611.42 | 706.03 | 716.61 | 713.84 |
| Temp. at Start of Boiling (° C.) | 846.13 | 864.15 | 846.85 | 847.01 |
| Temp. at Start of Convection (° C.) | 41.5 | 428.07 | 432.06 | 453.28 |
| Cooling Rate at 300° C. (° C./sec) | 90.59 | 26.74 | 24.74 | 26.47 |
| Time to 600° C. (sec) | 1.54 | 2.02 | 1.84 | 1.81 |
| Time to 400° C. (sec) | 2.61 | 5.51 | 5.44 | 5.82 |
| Time to 200° C. (sec) | 5.05 | 13.26 | 13.87 | 14.54 |
| | Working Example 1-4 | Working Example 1-5 | Working Example 1-6 | Working Example 1-7 |
| SQ1500 Con. (wt %) | 15 | 15 | 15 | 15 |
| PK 812 Con. (wt %) | 0.2 | 0.5 | 1 | 1.5 |
| Maximum Cooling Rate (° C./sec) | 148.55 | 119.77 | 102.75 | 64.34 |
| Temp. Max. Cooling rate (° C.) | 742.95 | 752.46 | 778.4 | 780.71 |
| Temp. at Start of Boiling (° C.) | 848.73 | 846.75 | 847.71 | 847.55 |
| Temp. at Start of Convection (° C.) | 600.02 | 634.14 | 678.96 | 690.1 |
| Cooling Rate at 300° C. (° C./sec) | 22.98 | 19.25 | 15.14 | 12.64 |
| Time to 600° C. (sec) | 2.23 | 3.75 | 5.33 | 6.91 |
| Time to 400° C. (sec) | 5.61 | 9.31 | 15.27 | 13.25 |
| Time to 200° C. (sec) | 15.75 | 18.89 | 29.77 | 29.52 |

Working Example 2

Effect of Inorganic Nanoparticle and Polymer to Cooling Curve

Figure 4:
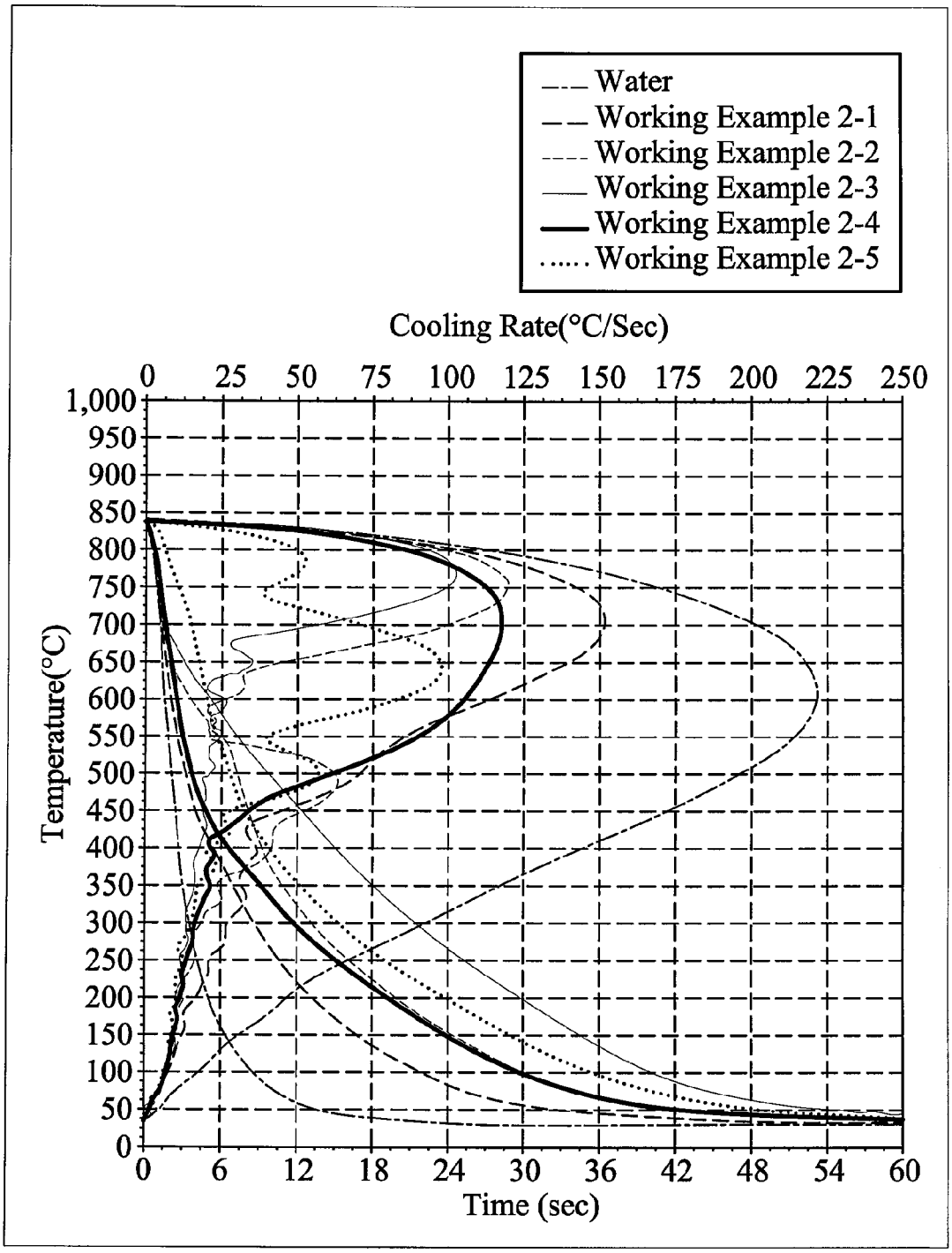
FIG. 4 is a graph plotting time and cooling rate against temperature of the quenchant as disclosed in Working Example 2.

The same procedure carried out in Comparative Example 1 was repeated except that the components of the quenchant was changed to 15 wt %, 20 wt %, and 25 wt % of an SQ1500 polymer and 0.5 wt % and 1.0 wt % of a PK812 inorganic nanoparticle, respectively. Referring to FIG. 4 and Table 4, maximum cooling rate and cooling rate at 300° C. decreased, dependant upon the increased amount of the PK812 inorganic nanoparticle, and temperature at start of convection increased, dependant on the increased amount of PK812 inorganic nanoparticle.

TABLE 4 properties of Working Example 2 quenchant

| | Water | Working Example 2-1 | Working Example 2-2 | Working Example 2-3 |
|---|---|---|---|---|
| SQ1500 (wt %) | 0 | 15 | 15 | 15 |
| PK 812 Con. (wt %) | 0 | 0 | 0.5 | 1 |
| Maximum Cooling Rate (° C./sec) | 221.43 | 151.86 | 119.77 | 102.75 |
| Temp. Max. Cooling rate (° C.) | 611.42 | 706.03 | 752.46 | 778.4 |
| Temp. at Start of Boiling (° C.) | 846.13 | 846.15 | 846.75 | 847.71 |
| Temp. at Start of Convection (° C.) | 41.5 | 428.07 | 634.14 | 678.96 |
| Cooling Rate at 300° C. (° C./sec) | 90.59 | 26.74 | 19.25 | 15.14 |
| Time to 600° C. (sec) | 1.54 | 2.02 | 3.75 | 5.33 |
| Time to 400° C. (sec) | 2.61 | 5.51 | 9.31 | 15.27 |
| Time to 200° C. (sec) | 5.05 | 13.26 | 19.89 | 29.77 |

| | Working Example 2-4 | Working Example 2-5 |
|---|---|---|
| SQ1500 (wt %) | 20 | 25 |
| PK 812 Con. (wt %) | 0 | 0 |
| Maximum Cooling Rate (° C./sec) | 118.03 | 97.57 |
| Temp. Max. Cooling rate (° C.) | 710.88 | 652.38 |
| Temp. at Start of Boiling (° C.) | 848.16 | 747.03 |
| Temp. at Start of Convection (° C.) | 410.67 | 552.1 |
| Cooling Rate at 300° C. (° C./sec) | 16.6 | 14.94 |
| Time to 600° C. (sec) | 2.47 | 4.79 |
| Time to 400° C. (sec) | 6.87 | 9.94 |
| Time to 200° C. (sec) | 19.25 | 23.86 |

50CrMo4 Steel Analysis

Working Example 3

Effect of Inorganic Nanoparticle to Cooling Curve

Figure 5:
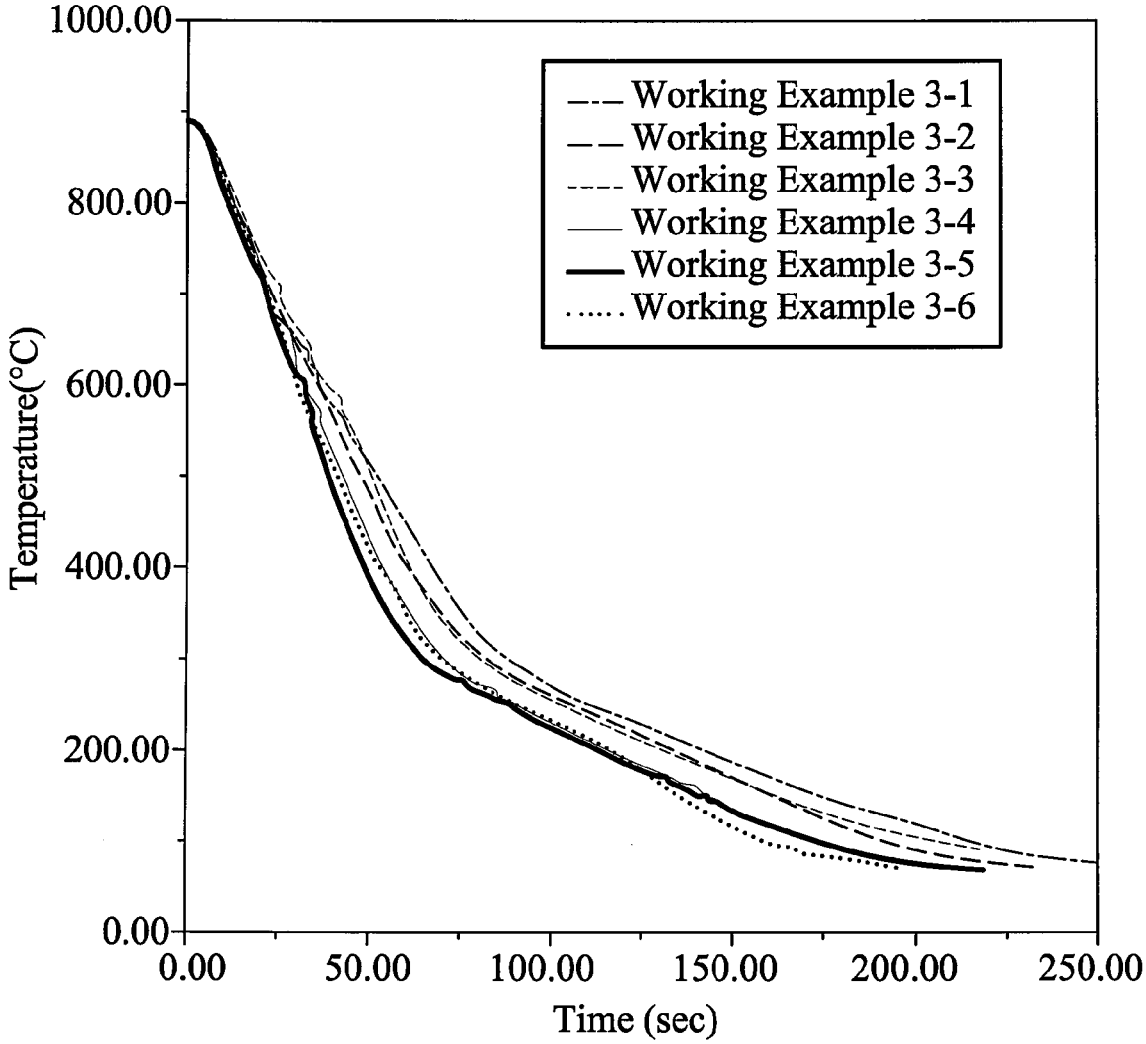
FIG. 5 is a graph plotting time against temperature of the quenchant as disclosed in Working Example 3.

50CrMo4 steel (10 mm diameter and 100 mm length) was treated with a quenchant of Example 3 and the cooling rate of the 50CrMo4 steel was detected by an IVF smart quench (IVF Industrial R&D Corporation). The quenchant of Example 3 comprised 2% of an FQ2000 (Petrofer) and 0 wt % to 1 wt % of a PK 812 inorganic nanoparticle (PAI KONG NANO Technology Co., LTD) as shown in Table 5. The viscosity of the quenchant increased when the concentration of the PK 812 inorganic nanoparticle increased. Referring to FIG. 5, cooling rate at 300° C. increased, dependant upon the increased amount of the PK812 inorganic nanoparticle (cooling curve of steel was gradually flatted).

TABLE 5

| | properties of Working Example 3 quenchant | | | | | |
|---|---|---|---|---|---|---|
| | Working Example 3-1 | Working Example 3-2 | Working Example 3-3 | Working Example 3-4 | Working Example 3-5 | Working Example 3-6 |
| FQ2000 Con. (wt %) | 2 | 2 | 2 | 2 | 2 | 2 |
| PK812 Con. (wt %) | 1 | 0.75 | 0.5 | 0.25 | 0.1 | 0 |
| pH value | 10 | 10 | 10 | 10 | 10 | 10 |
| viscosity(cps) | 22 | 12 | 10.2 | 7.6 | 7 | — |

Working Example 4

Effect of Inorganic Nanoparticle to Cooling Curve

Figure 6:
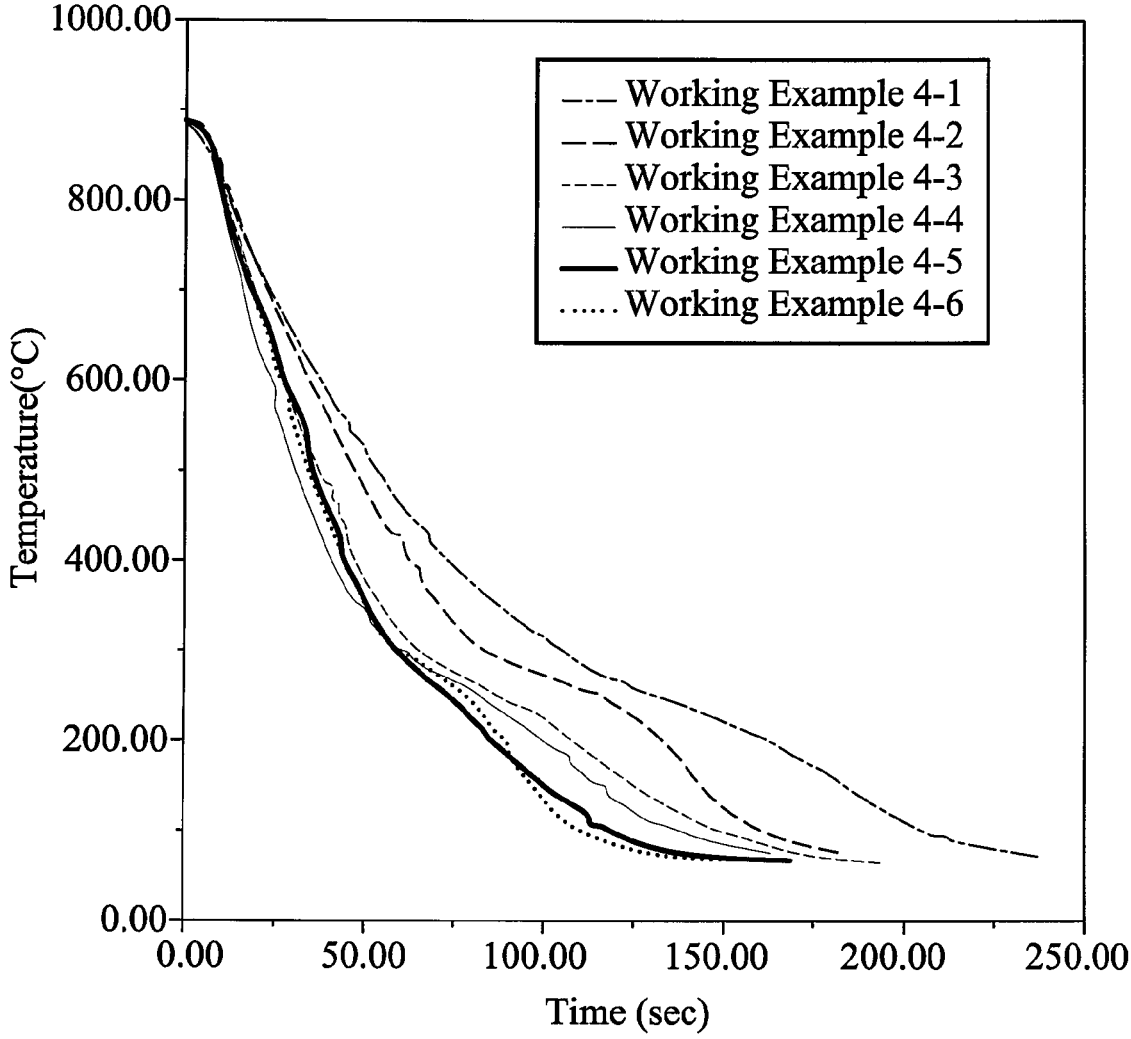
FIG. 6 is a graph plotting time against temperature of the quenchant as disclosed in Working Example 4.

The same procedure carried out in Example 1 was repeated except that the PK812 inorganic nanoparticle was changed to 0 wt % to 0.75 wt % of a PK811A (PAI KONG NANO Technology Co., LTD), as shown in Table 6. The viscosity of the quenchant increased when the concentration of PK811A inorganic nanoparticle increased. Referring to FIG. 6, cooling rate at 300° C. increased, dependent upon the increased amount of the PK812 inorganic nanoparticle (cooling curve of steel was gradually flatted).

TABLE 6

| | properties of Working Example 3 quenchant | | | | | |
|---|---|---|---|---|---|---|
| | Working Example 4-1 | Working Example 4-2 | Working Example 4-3 | Working Example 4-4 | Working Example 4-5 | Working Example 4-6 |
| FQ2000 Con. (wt %) | 2 | 2 | 2 | 2 | 2 | 2 |
| PK811A Con. (wt %) | 0.75 | 0.5 | 0.25 | 0.1 | 0.05 | 0 |
| pH value | 8 | 8 | 8 | 8 | 8 | 8 |
| viscosity(cps) | 13.5 | 8.5 | 5 | 5 | 5.1 | 4.8 |

Working Example 5

Effect of Inorganic Nanoparticle to Cooling Curve

Figure 7:
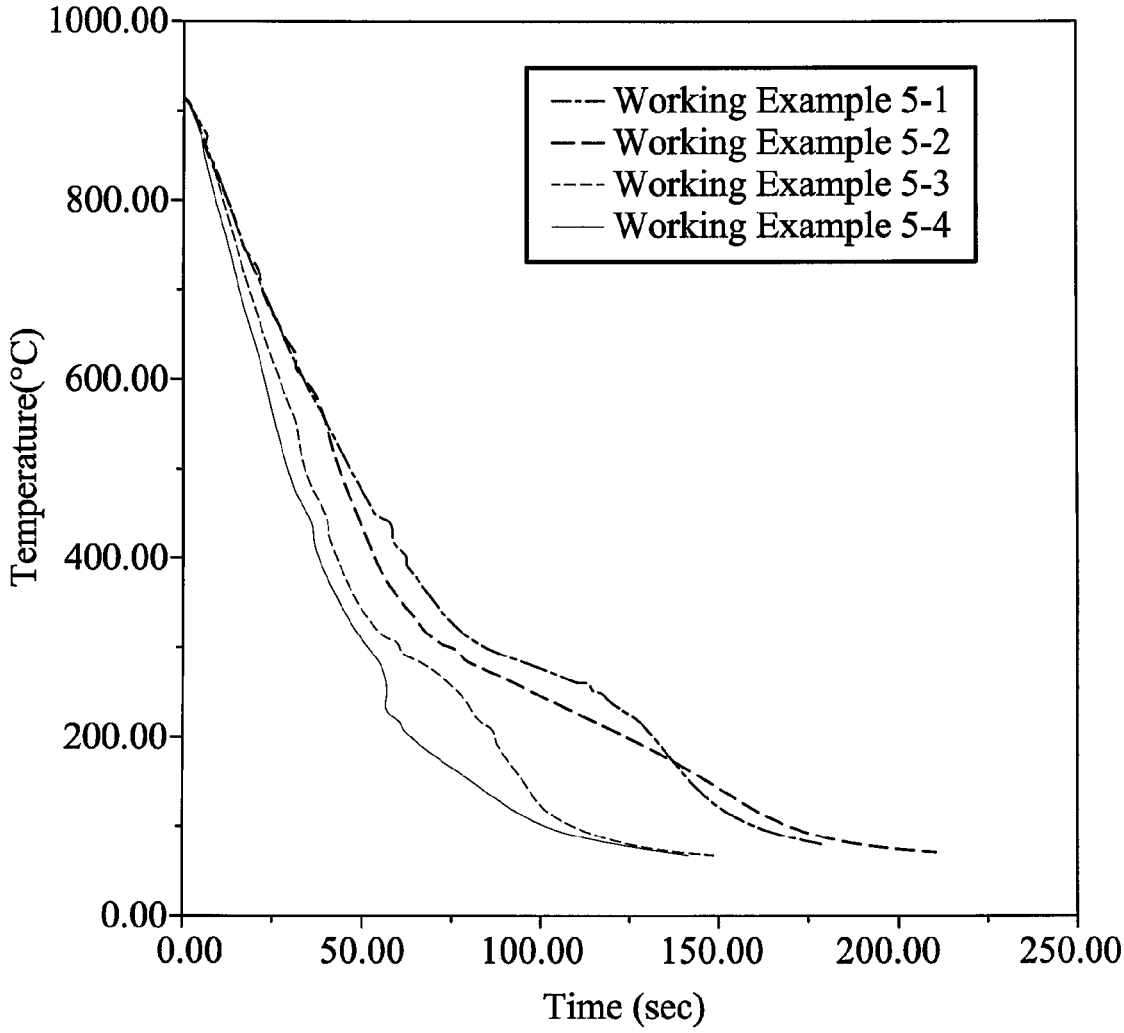
FIG. 7 is a graph plotting time against temperature of the quenchant as disclosed in Working Example 5.

The same procedure carried out in Example 3 was repeated except that the inorganic nanoparticle was changed. The concentration and variety of the inorganic nanoparticle were illustrated as in Table 7. Referring to FIG. 7, cooling rate at 300° C. increased, dependent upon the increased amount of the inorganic nanoparticle (cooling curve of steel was gradually flatted).

TABLE 7

| | properties of Working Example 3 quenchant | | | |
|---|---|---|---|---|
| | Working Example 5-1 | Working Example 5-2 | Working Example 5-3 | Working Example 5-4 |
| FQ2000 Con. (wt %) | 2 | 2 | 2 | 2 |
| inorganic nanoparticle Con. (wt %) | 0 | 0.5 (PK811A) | 0.5 (PK812) | 0.5 ($SiO_2$) |
| pH value | 8 | 8 | 8 | 8 |
| viscosity (cps) | 4.8 | 8.5 | 9.5 | 5.1 |

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A polymeric quenchant, comprising an inorganic nanoparticle, a water-soluble polymer, and water, wherein a weight ratio of the inorganic nanoparticle, water-soluble polymer and water is about 0.05-5:1-5:100, and the inorganic nanoparticle is talc, smectite clay, vermiculite, halloysite, sericite, saponite, montmorillonite, beidellite, nontronite, mica, hectorite, or a combination thereof.

2. The polymeric quenchant as claimed in claim 1, further comprising a functional agent.

3. The polymeric quenchant as claimed in claim 2, wherein the functional agent comprises triethylamine or triethanolamine.

4. The polymeric quenchant as claimed in claim 1, wherein the inorganic nanoparticle comprises a plural number of inorganic nanoparticles.

5. The polymeric quenchant as claimed in claim 1, wherein the water-soluble polymer comprises polyalkylene glycol, polyvinyl pyrrolidone, polyacrylate, polyvinyl alcohol, polyacrylamide, poly(ethyloxazoline), polyalphaolefin, poly(ethylene glycol), polyethylenimine, or a combination thereof.

6. A method of manufacturing a polymeric quenchant, comprising:

providing an inorganic nanoparticle, wherein the inorganic nanoparticle is dispersed in water; and adding a water-soluble polymer to the water comprising the inorganic nanoparticle;

wherein a weight ratio of the inorganic nanoparticle, water-soluble polymer and water is about 0.05-5:1-5:100 and the inorcianic nanoparticle is talc, smectite clay, vermiculite, halloysite, sericite, saponite, montmorillonite, beidellite, nontronite, mica, hectorite, or a combination thereof.

7. The method as claimed in claim 6, wherein the polymeric quenchant further comprises a functional agent.

8. The method as claimed in claim 7, wherein the functional agent comprises triethylamine or triethanolamine.

9. The method as claimed in claim 6, wherein the inorganic nanoparticle comprises a plural number of inorganic nanoparticles.

10. The method as claimed in claim 6, wherein the water-soluble polymer comprises polyalkylene glycol, polyvinyl pyrrolidone, polyacrylate, polyvinyl alcohol, polyacrylamide, poly(ethyloxazoline), polyalphaolefin, poly(ethylene glycol), polyethylenimine, or a combination thereof.

* * * * *